US010190241B2

(12) United States Patent
Nocenti

(10) Patent No.: US 10,190,241 B2
(45) Date of Patent: Jan. 29, 2019

(54) LINKING DEVICE AND MACHINE COMPRISING SAID DEVICE

(71) Applicant: STÄUBLI ITALIA S.P.A., Carate Brianza (MI) (IT)

(72) Inventor: Robert Nocenti, Marlens (FR)

(73) Assignee: STÄUBLI ITALIA S.P.A., Carate Brianza (MI) (IT)

( * ) Notice: Subject to any disclaimer, the term of this patent is extended or adjusted under 35 U.S.C. 154(b) by 171 days.

(21) Appl. No.: 15/469,739

(22) Filed: Mar. 27, 2017

(65) Prior Publication Data

US 2017/0283997 A1 Oct. 5, 2017

(30) Foreign Application Priority Data

Apr. 1, 2016 (IT) ..... 102016000033775

(51) Int. Cl.

| | |
|---|---|
| ***D04B 9/40*** | (2006.01) |
| ***D04B 9/46*** | (2006.01) |
| ***D04B 15/02*** | (2006.01) |
| ***D05B 23/00*** | (2006.01) |

(52) U.S. Cl.

CPC ..... *D04B 9/40* (2013.01); *D04B 9/46* (2013.01); *D04B 15/02* (2013.01); *D05B 23/00* (2013.01); *D05B 23/009* (2013.01)

(58) Field of Classification Search

CPC . D04B 9/40; D04B 9/46; D04B 15/02; D05B 23/00; D05B 23/009

See application file for complete search history.

(56) References Cited

U.S. PATENT DOCUMENTS

| | | | | |
|---|---|---|---|---|
| 2,515,740 | A | 7/1950 | Smith et al. | |
| 6,779,472 | B1 * | 8/2004 | Green | D05B 23/009 112/470.15 |
| 8,443,633 | B1 * | 5/2013 | Inli | D04B 1/108 66/148 |
| 8,893,529 | B1 * | 11/2014 | Inli | D05B 23/009 66/148 |
| 2001/0039816 | A1 * | 11/2001 | Fujiwara | D04B 15/06 66/13 |
| 2016/0024695 | A1 | 1/2016 | Conti et al. | |
| 2017/0283997 | A1 * | 10/2017 | Nocenti | D04B 9/40 |

FOREIGN PATENT DOCUMENTS

| | | | |
|---|---|---|---|
| CH | 264 876 | A | 11/1949 |
| WO | 2004/035894 | A1 | 4/2004 |
| WO | 2009/144049 | A1 | 12/2009 |
| WO | 2010/086708 | A1 | 8/2010 |

* cited by examiner

*Primary Examiner* — Danny Worrell
(74) *Attorney, Agent, or Firm* — McGlew and Tuttle, P.C.

(57) ABSTRACT

The linking device (9) includes a first bowed needle (17) mounted on a first shaft (13) and a second bowed needle (19) mounted on a second shaft (15). The first shaft (13) and the second shaft (15) are mutually inclined to each other and are controlled in order to pivot alternatingly around a pivot axis (A-A) of the first shaft (13) and a pivot axis (B-B) of the second shaft (15), respectively. The first shaft (13) is rigidly coupled to a first pin (27) pivoting therewith; the second shaft (15) is rigidly coupled to a second pin (31) pivoting therewith; and a slider (35) is slidingly mounted on the first pin (27) and on the second pin (31).

21 Claims, 10 Drawing Sheets

LINKING DEVICE AND MACHINE COMPRISING SAID DEVICE

FIELD OF THE INVENTION

The present invention relates to a linking device for sewing or linking edges of fabric, for example for sewing or linking the toes of stockings or other tubular knitted articles.

BACKGROUND ART

In the textile field, and especially in the hosiery and knitting industry, the production is well known of tubular knitted articles, for example stockings, socks and tights, using circular knitting machines. In some cases, the toe of the tubular knitted article shall be closed by linking or sewing. There are circular knitting machines producing tubular knitted articles with closed toe. These machines are however complex and expensive.

In many cases, the tubular knitted article exits from the circular knitting machine with the open toe, and shall be transferred to a sewing or a linking machine. To this end, there are devices taking the tubular knitted article from the needle cylinder of the circular knitting machine and transferring it to the sewing machine or the linking machine. Examples of this type of devices are disclosed in WO2004/035894, WO2010/086708, US20160024695.

Usually, the linking devices comprise two bowed needles provided with reciprocating rotary motion for linking by means of two yarns. A critical aspect of these devices is the adjustment of the needle position with respect to the members on which the tubular knitted article is engaged, constituted for example by spikes of a linking machine, or by pick-up hooks that are also used to take the tubular knitted article from the needle cylinder of the circular knitting machine (see US20160024695).

There is therefore a need for a simpler linking device wherein the adjustment of the needle position is easier.

SUMMARY OF THE INVENTION

According to a first aspect, the invention relates to a linking device comprising a first bowed needle mounted on a first shaft and a second bowed needle mounted on a second shaft. The first shaft and the second shaft are mutually inclined to each other, i.e. they are so arranged that their axes are not parallel to each other. They are controlled in order to pivot reciprocatingly around a pivoting axis of the first shaft and a pivoting axis of the second shaft, respectively. The linking device also comprises a first pin rigidly coupled to the first shaft and pivoting therewith, and a second pin rigidly coupled to the second shaft and pivoting therewith. A slider connects the first pin and the second pin, being slidingly mounted on both the pins. By driving one of the two shafts into reciprocating pivoting motion, for example by means of an electric motor, said one shaft can transfer the motion to the other shaft through the coupling provided by means of the two pins and the slider mounted slidingly on them.

In this way a particularly simple device is provided, easy to be maintained and adjusted, of limited costs and very efficient and accurate.

Further advantageous features and embodiments of the linking device will be described below with reference to the drawing, and in the attached claims.

The first pin may be, for instance, parallel to the first shaft and spaced therefrom. Analogously, the second pin may be parallel to the second shaft and spaced therefrom.

In advantageous embodiments, the two shafts are oriented at 90° to each other, i.e. their axes are spaced from each other and lie on different planes, but are orthogonal to each other in a plan view. The slider may have two sliding seats, wherein the two pins are slidingly engaged. The two seats may be rigidly connected to each other, i.e. the slider may comprise a single rigid component where the two sliding seats for the pins are provided. The distance between the two seats, i.e. the distance between two parallel axes, containing the axes of the sliding seats, may be equal to the distance between parallel planes containing the pivoting axes of the two shafts.

For at least one of the two bowed needles, the distance between the respective pin and the pivot shaft can be adjusted. It can also be envisaged to provide this adjustment capability for both the bowed needles.

In some embodiments, at least one of the bowed needles, and preferably both needles, are adjustable, with respect to a supporting structure, in a direction parallel to the pivoting axis of the respective shaft.

In practical embodiments, one or both the bowed needles lie in a plane orthogonal to the pivoting axis of the respective shaft.

According to a further aspect, the invention relates to a linking machine for linking edges of a knitted article comprising engagement members for engaging loops of the knitted article, and a linking device according to the invention.

BRIEF DESCRIPTION OF THE DRAWINGS

A more complete understanding of the illustrated embodiments of the invention and the many advantages achieved will be obtained with reference to the detailed description below in combination with the appended drawings, wherein.

DETAILED DESCRIPTION OF EMBODIMENTS

Figure 1:
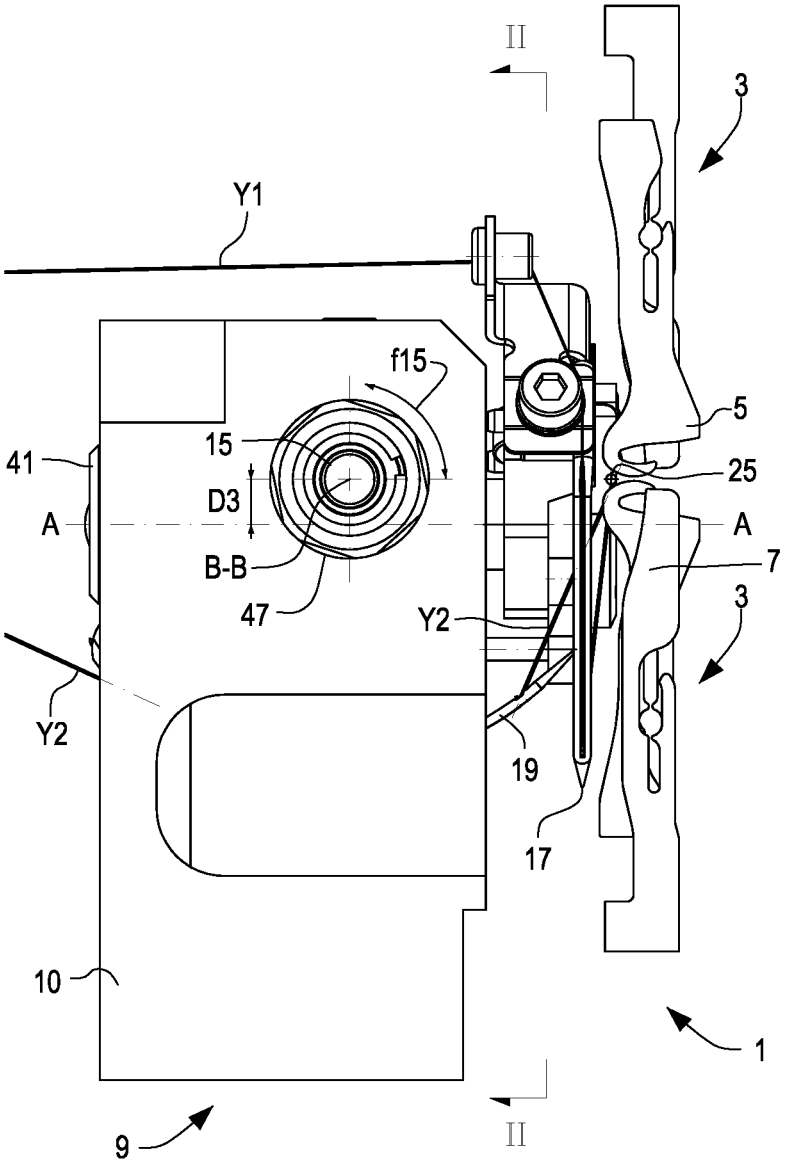
FIG. 1 shows a side view of the linking device in combination with a support member for supporting the tubular knitted article to be linked.

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In FIGS. 1-5 the linking device is shown in combination with a support system 1 for an article to be linked, for example a sock. Number 3 generically indicates engagement members for engaging the knitted article, not shown, that are part of the support system 1. The engagement member 3 may comprise hooks 5 and latches 7. It should be understood that, while in the attached figures only some engagement members 3 have been shown just by way of example, actually a full arc of engagement members may be provided, for example an approximately 180° arc of engagement members. The system 1 with the engagement members 3 may be designed as disclosed for instance in US20160024695. In other embodiments, the system 1 may be constituted by spikes of a linking machine, as described for example in WO2004/035894.

Figure 8A:
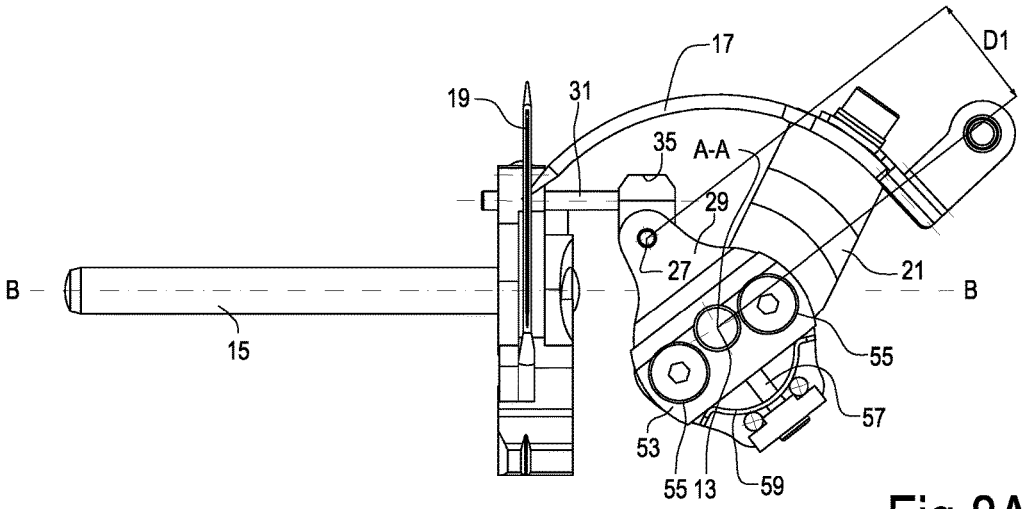
FIGS. 8A and 8B show a front view of an adjustment mechanism for adjusting the distance between one of the needles and the respective pin for the connection to the slider.
Figure 8B:
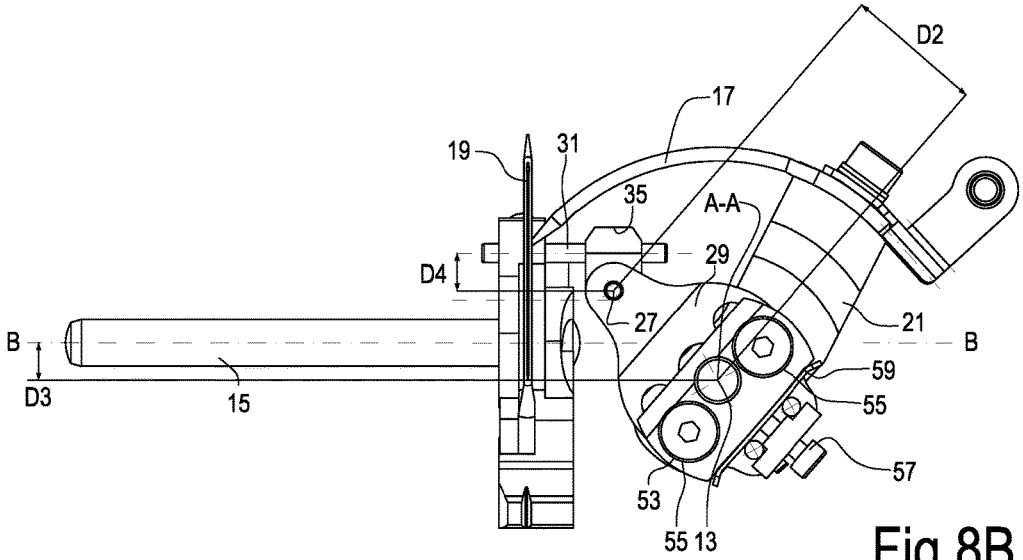

Reference number 9 indicates the linking device as a whole. It comprises a supporting structure 10, on which a first shaft 13 and a second shaft 15 are mounted. The first shaft 13 is provided with a pivoting, i.e. reciprocating, angular motion around a pivoting axis A-A, while the second shaft 15 is provided with a pivoting, i.e. reciprocating, angular motion around a pivoting axis B-B. In the illustrated embodiments, the two shafts 13 and 15, and therefore the two axes A-A and B-B, are directed at 90° with respect to each other, but they lie on two distinct parallel planes arranged at a distance D3, as shown in FIGS. 1 and 8B.

A first bowed needle 17 is integral with the first shaft 13, and a second bowed needle 19, below also called "crochet needle", is integral with the second shaft 15. The first bowed needle 17 moves on a plane orthogonal to the axis A-A when the first shaft 13 reciprocatingly pivots around the axis A-A, while the second bowed needle, or crochet needle, 19 moves on a plane orthogonal to the axis B-B when the second shaft 15 reciprocatingly pivots around the axis B-B.

Figure 7A:
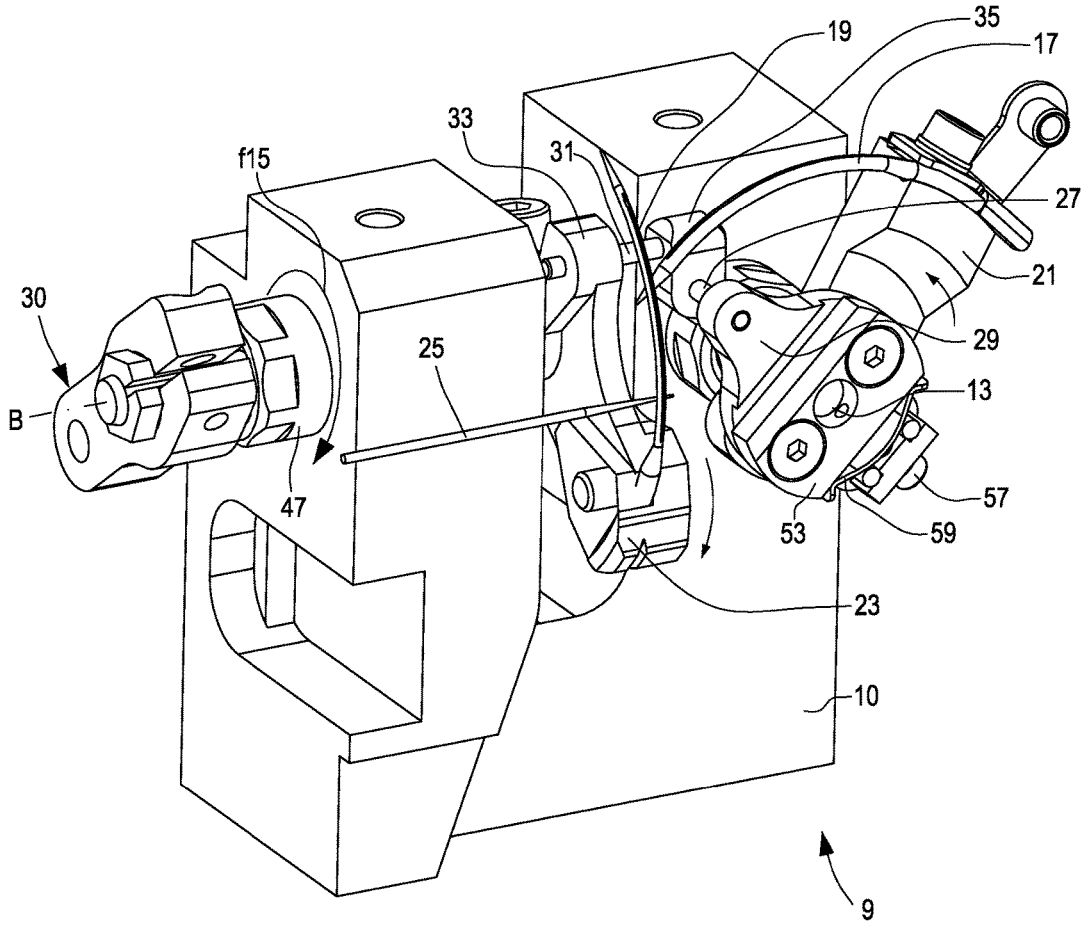
FIGS. 7A-7C show a movement sequence of the linking device.
Figure 7B:
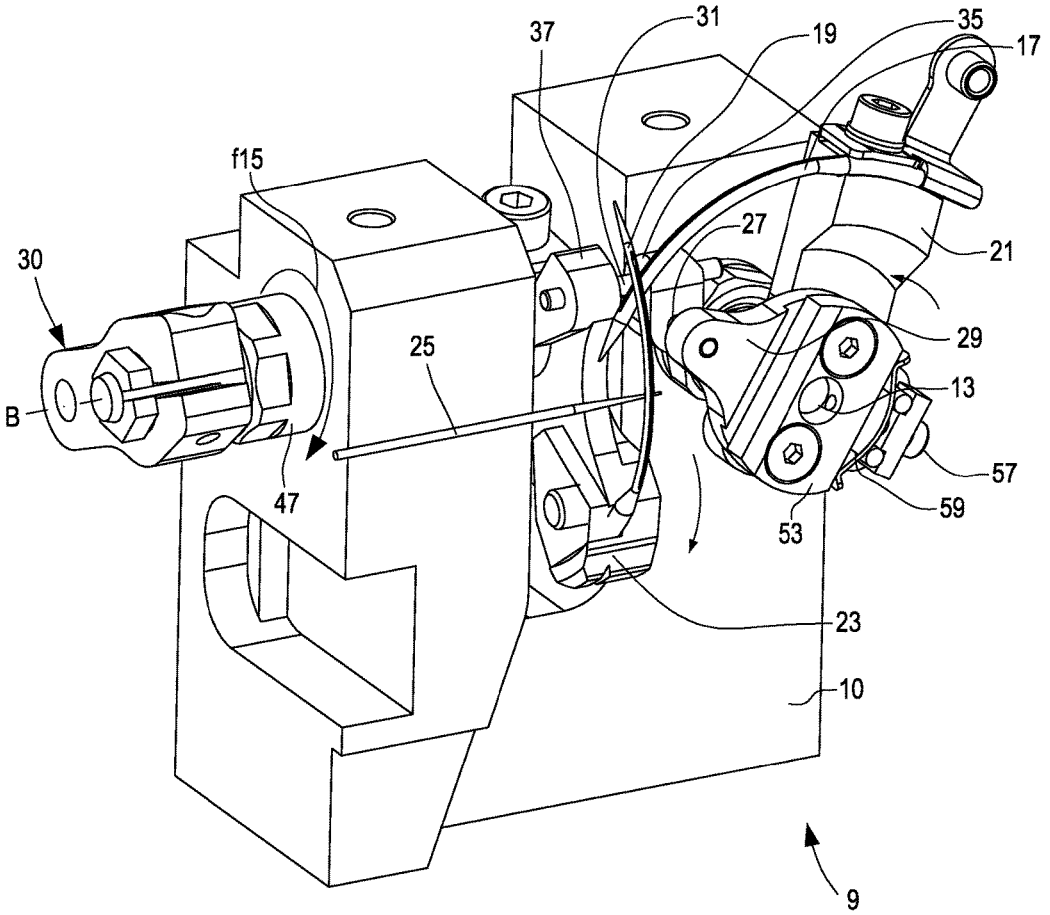
Figure 7C:
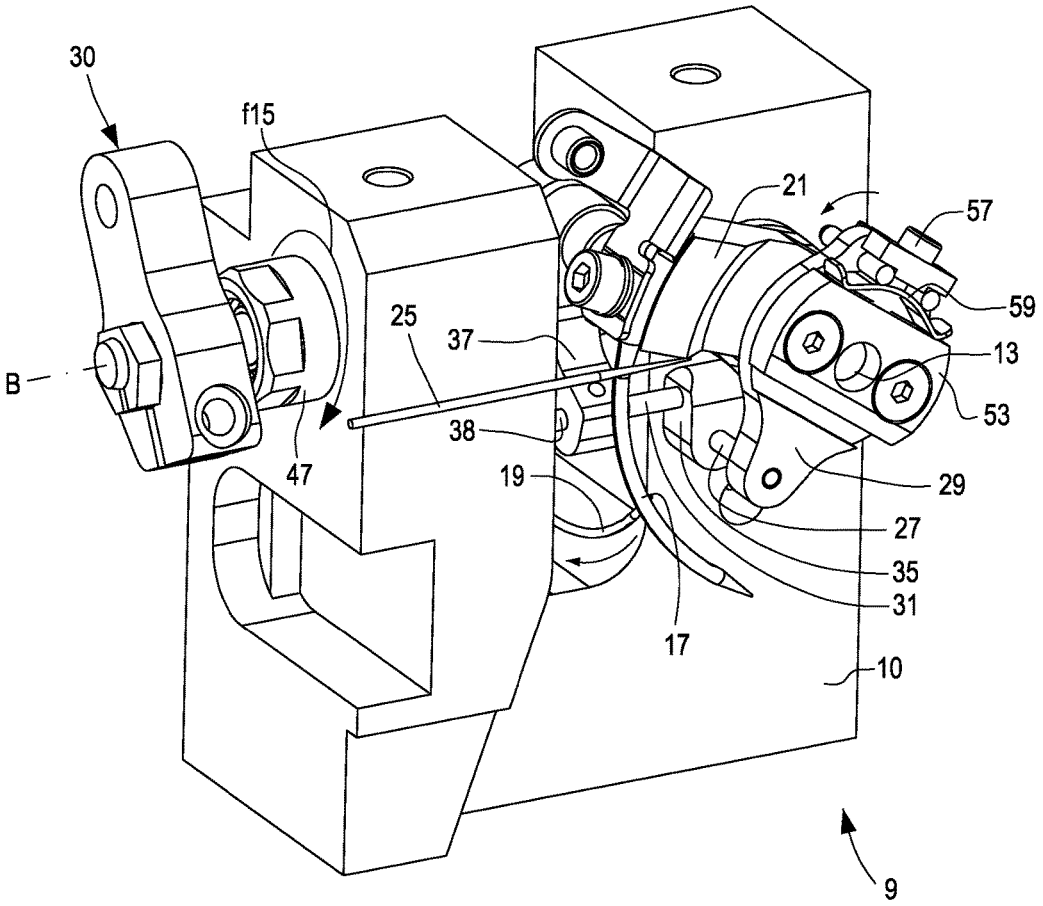

In the illustrated embodiment, the first bowed needle 17 is integral with the first shaft 13 by means of a first arm 21, while the second bowed needle 19 is integral with the second shaft 15 by means of a second arm 23 (see also the sequence in FIGS. 7A-7C).

A first yarn Y1 is fed to the first bowed needle 17, while a second yarn Y2 is fed to the second bowed needle 19. The first bowed needle 17 and the second bowed needle 19 cooperate with each other and with a stationary finger 25, that may be supported by the supporting structure 10 in a way not shown for the sake of drawing simplicity.

The pivoting motion of the first bowed needle 17 and of the second bowed needle 19, cooperating with each other and with the finger 25, allows to form a series of chain stitches for linking edges of fabric held adjacent to each other by means of the members 3, 5. The way for making the sewing or linking stitches is known to those skilled in the art and does not require to be described herein. The pivoting motion of the first bowed needle 17 is synchronized with the motion of the second bowed needle, or crochet needle, 19, and these motions are represented in the sequence of FIGS. 7A-7C. This sequence shows a portion of the sequence of motion of the bowed needles 17, 19, and precisely the sequence when the first bowed needle 17 and the second bowed needle, or crochet needle, 19 pivot from respective positions of maximum lifting (FIG. 7A) to respective positions of maximum lowering (FIG. 7C). The complete cycle of motion of the bowed needles 17, 19 comprises the reverse sequence (from FIG. 7C to FIG. 7A), when both the bowed needles 17, 19 move upwards from the position of maximum lowering to the position of maximum lifting.

Figure 2:
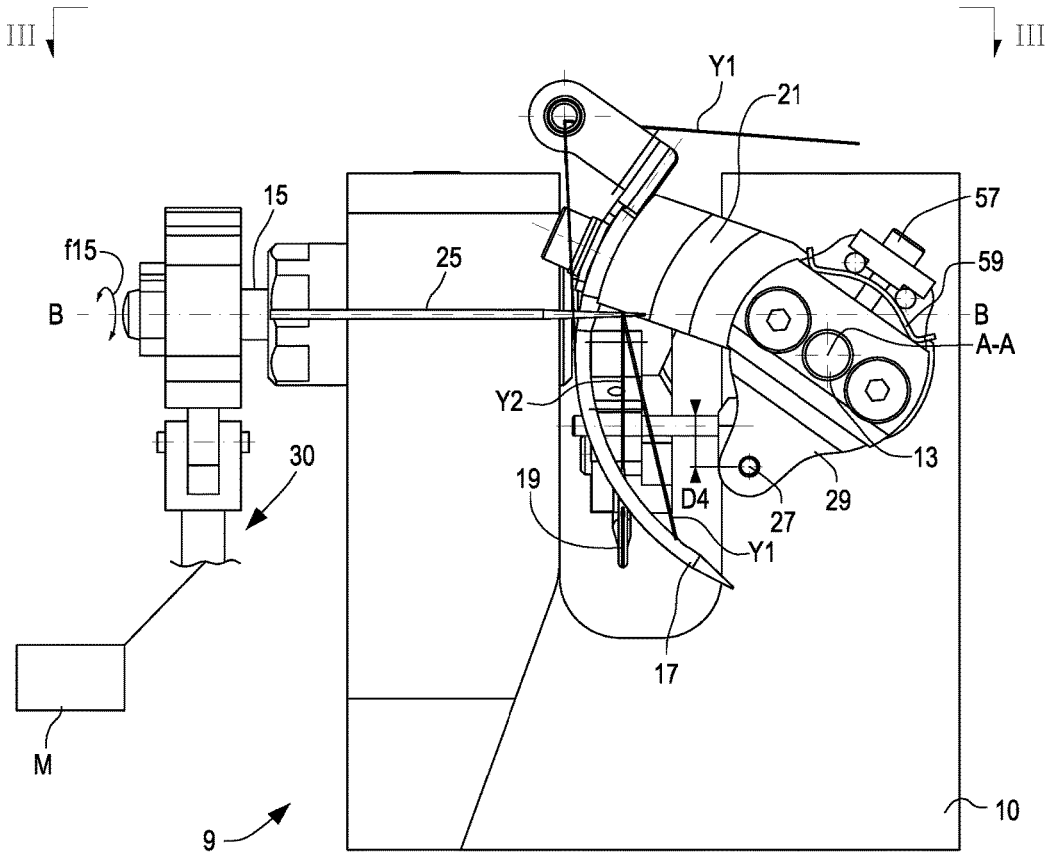
FIG. 2 shows a view according to II-II in FIG. 1.
Figure 3:
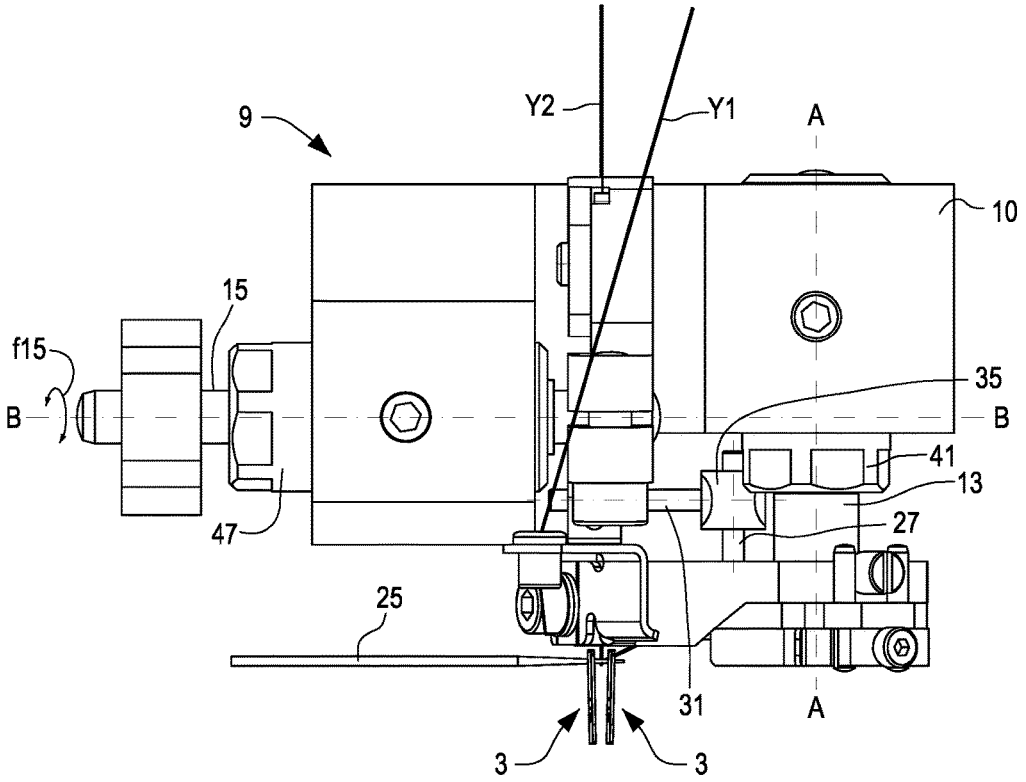
FIG. 3 shows a view according to III-III in FIG. 2.
Figure 4:
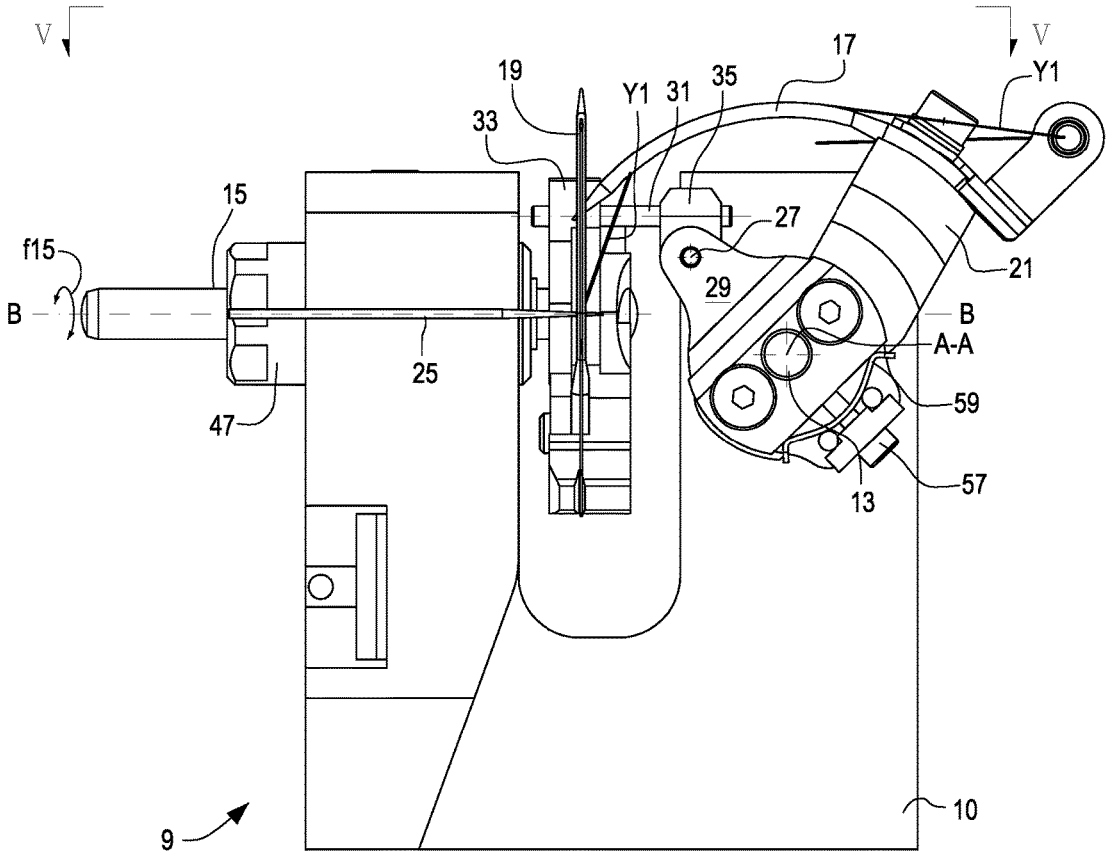
FIG. 4 shows a view according to II in FIG. 1, with the needles in a different angular position.

The movement may be imparted by means of an actuator, for example an electronically controlled electric motor, schematically indicated with M only in FIG. 2, which can be connected to the second shaft 15 by means of a suitable mechanical transmission, for example by means of a rod-crank system 30. The rod-crank system 30 changes the continuous rotation motion of the motor M into a reciprocating pivoting motion of the second shaft 15 and of the second bowed needle, or crochet needle, 19 around the axis B-B. The motion is transmitted to the first shaft 13 and to the first bowed needle 17 by means of a mechanism described below.

In other embodiments, not shown, the motor M may be connected, by means of a suitable mechanical transmission, to the first shaft 13 instead of being connected to the second shaft 15.

In order to transmit the motion from one to the other of the two shafts 13, 15, a first pin 27 is integral with the first shaft 13, the pin being carried by a first auxiliary arm 29. The first auxiliary arm 29 is rotatingly coupled to the first shaft 13, i.e. it pivots integrally therewith. The two arms 29 and 21 are angularly spaced from each other. In the illustrated embodiment, the first pin 27 is parallel to the first shaft 13.

A second pin 31 is integral with the second shaft 15. The second pin may be carried by a second auxiliary arm 33, rotatingly constrained with the second shaft 15, i.e. the second pin 31 pivots integrally with the second shaft 15. The second auxiliary arm 33 is angularly spaced from the second arm 23 constraining the second bowed needle 19 to the second shaft 15. The second pin 31 is parallel to the second shaft 15.

The first pin 27 and the second pin 31 are mechanically coupled to each other by means of a slider 35. The slider 35 may comprise two sliding seats 36, 38 (FIG. 6A), oriented at 90° with respect to each other but lying on two distinct planes. The first pin 27 is inserted in the sliding seat 36, while the second pin 31 is inserted in the seat 38. The distance between two parallel planes containing the axes of the sliding seats (and therefore the axes of the first pin 27 and of the second pin 31) is indicated with D4 in FIGS. 2 and 8B.

Advantageously, the distance D4 between the parallel planes containing the axis of the first pin 27 and the axis of the second pin 31, corresponding to the distance between the axis of the seats 36 and the axis of the seat 38, is equal to the distance D3 between the parallel planes containing the pivoting axis A-A of the first shaft 13 and the pivoting axis B-B of the second shaft 15. In this way, the two bowed needles 17 and 19 perform the same movements.

As it is clearly apparent from the sequence of FIGS. 7A-7C, when the second shaft 15 is driven into reciprocating pivoting motion according to the arrow f15 by means of the motor M, the reciprocating pivoting motion is transmitted to the first shaft 13, and thus to the first bowed needle 17, through the pins 31 and 27 and through the slider 35. During the motion, each of the two pins 27, 31 slides and pivots in the respective seat provided in the slider 35, and the slider is substantially moved by means of the pins 27, 31 to which it is constrained.

Thanks to this mechanical transmission between the two bowed needles 17 and 19, provided by means of the slider 35 and of the pins 27, 31, it is possible to have a simpler adjustment of the position of each bowed needle 17, 19 with respect to the supporting structure 10, and therefore with respect to the system 1, independently of the other bowed needle. For example, it is possible to adjust the position of the first bowed needle 17 parallel to the axis A-A without changing the position of the second bowed needle 19. Similarly, the axial position of the second bowed needle 19 parallel to the axis B-B may be adjusted independently of the first bowed needle 17.

Figure 5:
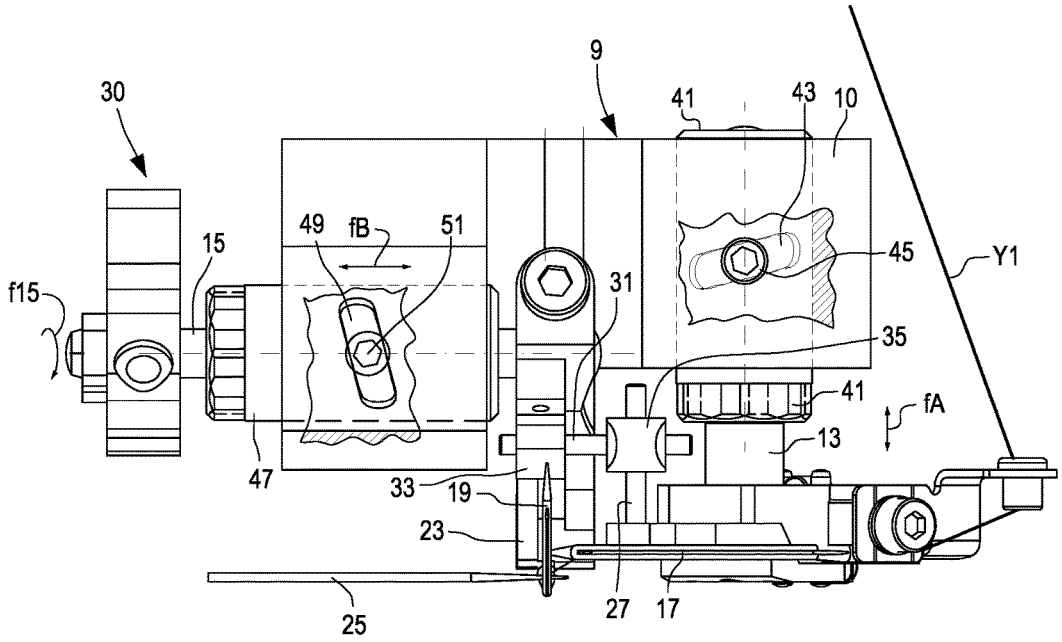
FIG. 5 shows a view according to V-V in FIG. 4.
Figure 6:
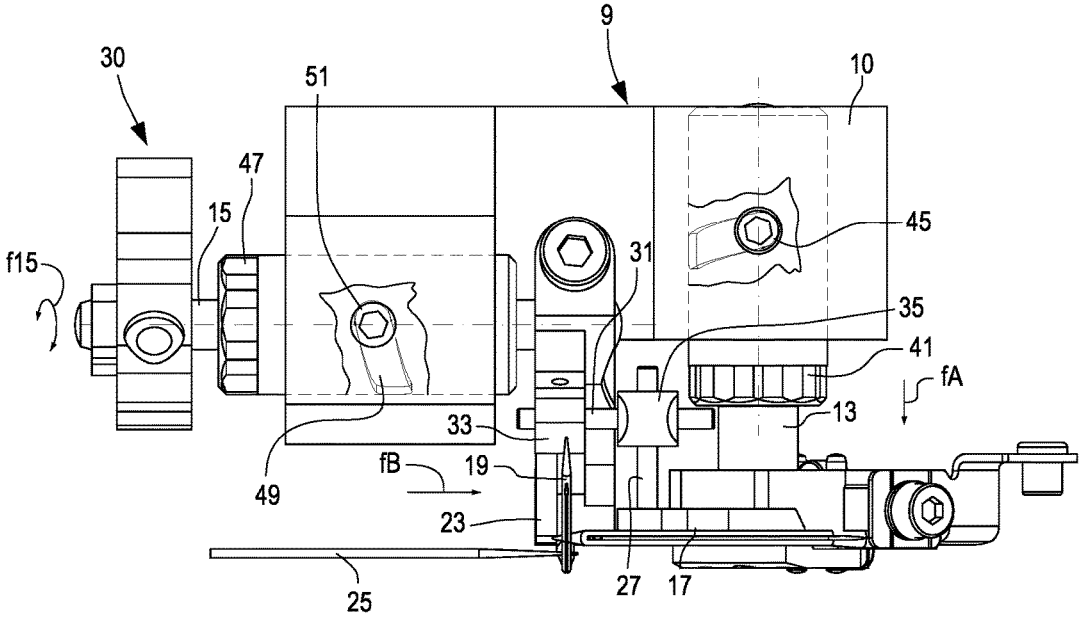
FIG. 6 shows a view analogous to that of FIG. 5, with the needles in a different axial position.
Figure 6A:
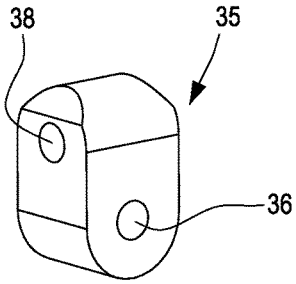
FIG. 6A shows an axonometric view of the slider connecting the two bowed needles of the linking device.

The possibility of adjusting the position of the bowed needles 17, 19 with respect to the reciprocating pivoting axis A-A and to the reciprocating pivoting axis B-B is shown in detail in FIGS. 5 and 6. In FIGS. 5 and 6, each of the two bowed needles 17, 19 is shown in two different axial positions. The adjustment of the position of the bowed needles 17 is performed according to the arrow fA, while the adjustment of the position of the bowed needle 19 is performed according to the arrow fB, in each case in a direction parallel to the respective pivoting axis A-A and B-B.

An adjustment arrangement may be provided for independently adjusting the position of each bowed needle 17, 19 in the direction of the axis A-A and of the axis B-B respectively. FIGS. 5 and 6 show a possible embodiment of this adjustment arrangement. The first shaft 13 may be pivotingly supported in a first sleeve 41 housed in the supporting structure 10. The first sleeve 41 has a helical groove 43 where a fastening screw engages. By tightening the fastening screw 45, the first sleeve 41 is axially and torsionally blocked in the supporting structure 10. By loosening the fastening screw 45, it is possible to rotate the first sleeve 41 around the axis A-A. As the fastening screw 45 remains engaged in the helical groove 43, the rotation of the first sleeve 41 around the axis A-A causes a corresponding axial movement of the first sleeve 41 according to the arrow fA in the housing seat of the supporting structure 10. As the first shaft 13 is rotatable supported in the first sleeve 41, but it is axially blocked with respect thereto, the translation of the first sleeve 41 according to fA causes a corresponding translation of the first shaft 13 and of the first bowed needle 17 according to the arrow fA.

The adjustment of the position of the first bowed needle 17 according to the direction of the axis A-A is performed as follows: the fastening screw 45 is loosed, while keeping it engaged in the helical groove 43. The first sleeve 41 rotates around the axis A-A until the first bowed needle 17 achieves the desired position, and lastly the fastening screw 45 is tightening again until the first sleeve 41 is blocked in the selected axial position.

The adjustment of the position of the second bowed needle, or crochet needle, 19 in the direction of the axis B-B is performed with substantially the same arrangement. To this end, a second sleeve 47 is provided, housed in a seat of the supporting structure 10 and provided with a helical groove 49. A fastening screw 51 engages the helical groove 49. The adjustment of the position of the second bowed needle 19 according to the arrow fB is performed similarly to what has been already described with reference to the first bowed needle 17.

In some embodiments, a further adjustment possibility may be provided for the linking device 9. This further adjustment possibility is clearly shown in FIGS. 8A and 8B, showing a view of the two bowed needles 17, 19, of the respective shafts 13, 15, of the slider 35 and of the pins 27, 31, according to the axis A-A. In FIGS. 8A and 8B the supporting structure 10 and the sleeves 41 and 47 have been omitted.

As it is shown in FIGS. 8A and 8B, the distance between the first pin 27 and the axis A-A of the first shaft 13 is adjustable. This distance is indicated with D1 in FIG. 8A and with D2 in FIG. 8B, wherein D1 is shorter than D2. In order to adjust the distance between the first pin 27 and the axis A-A of the first shaft 13, it is possible to block the first pin 27, and the first auxiliary arm 29 carrying it, by means of a plate 53 fastened to the head of the first shaft 13 through fastening screws 55. By loosening the fastening screws 55 the position of the first auxiliary arm 29, and therefore the distance of the first pin 27, can be adjusted with respect to the axis A-A. Once the required distance between the first pin 27 and the axis A-A has been achieved, the fastening screws 55 may be tightened again.

In order to simplify the adjustment, an adjustment screw 57 and a pre-load spring 59 may be provided. The pre-load spring 59 pushes the first auxiliary arm 28 towards the position of minimum distance of the first pin 27 with respect to the axis A-A. Through the adjustment screw 57 the position of the pin 27 with respect to the axis A-A can be adjusted by pressing or releasing the pre-load spring 59, as it is visible by comparing FIGS. 8A and 8B. This adjustment allows to modify the pivoting angle of one bowed needle with respect to the other bowed needle.

Also the distance between the second pin 31 and the axis B-B can be adjusted, in combination with or as an alternative to the adjustment of the distance between the first pin 27 and the axis A-A.

The invention claimed is:

1. A linking device comprising:

a first bowed needle mounted on a first shaft;

a second bowed needle mounted on a second shaft; wherein the first shaft and the second shaft are mutually inclined to each other and are controlled in order to pivot reciprocatingly around a pivoting axis of the first shaft and a pivoting axis of the second shaft, respectively;

wherein: the first shaft is rigidly coupled to a first pin pivoting therewith; the second shaft is rigidly coupled to a second pin pivoting therewith; and a slider is slidingly mounted on the first pin and on the second pin.

2. The linking device of claim 1, wherein the first pin extends parallel to the first shaft at a distance therefrom, and the second pin extends parallel to the second shaft at a distance therefrom.

3. The linking device of claim 1, wherein the first shaft and the second shaft are oriented at 90° to each other.

4. The linking device of claim 1, wherein the first shaft and the second shaft are oriented at 90° to each other.

5. The linking device of claim 1, further comprising a driver, configured and arranged for controlling the pivoting movement of one of said first shaft and second shaft, the slider transmitting a pivoting motion to the other of said first shaft and second shaft through the first pin and the second pin.

6. The linking device of claim 2, further comprising a driver, configured and arranged for controlling the pivoting movement of one of said first shaft and second shaft, the slider transmitting a pivoting motion to the other of said first shaft and second shaft through the first pin and the second pin.

7. The linking device of claim 3, further comprising a driver, configured and arranged for controlling the pivoting movement of one of said first shaft and second shaft, the slider transmitting a pivoting motion to the other of said first shaft and second shaft through the first pin and the second pin.

8. The linking device of claim 4, further comprising a driver, configured and arranged for controlling the pivoting movement of one of said first shaft and second shaft, the slider transmitting a pivoting motion to the other of said first shaft and second shaft through the first pin and the second pin.

9. The linking device of claim 1, wherein the pivoting axis of the first shaft and the pivoting axis of the second shaft are located on two parallel planes, arranged at a distance from each other.

10. The linking device of claim 2, wherein the pivoting axis of the first shaft and the pivoting axis of the second shaft are located on two parallel planes, arranged at a distance from each other.

11. The linking device of claim 1, wherein the slider comprises a first sliding seat, wherein the first pin is slidingly engaged, and a second sliding seat, wherein the second pin is slidingly engaged.

12. The linking device of claim 10, wherein the slider comprises a first sliding seat, wherein the first pin is slidingly engaged, and a second sliding seat, wherein the second pin is slidingly engaged.

13. The linking device of claim 5, wherein the slider comprises a first sliding seat, in which the first pin is slidingly engaged, and a second sliding seat, in which the second pin is slidingly engaged; and wherein the first sliding seat and the second sliding seat are so spaced from each other that two parallel planes containing the axis of the first sliding seat and the axis of the second sliding seat are spaced from each other by a distance equal to the distance between the parallel planes containing the pivoting axis of the first shaft and the pivoting axis of the second shaft.

14. The linking device of claim 1, wherein the distance between at least one of said first shaft and second shaft and the respective one of said first pin and second pin is adjustable.

15. The linking device of claim 1, wherein the first bowed needle lies in a plane orthogonal to the pivoting axis of the first shaft.

16. The linking device of claim 1, wherein the second bowed needle lies in a plane orthogonal to the pivoting axis of the second shaft.

17. The linking device of claim 1, further comprising an adjustment arrangement, for adjusting the position of at least one of the first bowed needle and second bowed needle in a direction parallel to the pivoting axis of the respective shaft.

18. The linking device of claim 17, wherein: the adjustment arrangement comprises a sleeve mounted on a supporting structure, the shaft of the at least one bowed needle being mounted for rotation in the sleeve; and the sleeve is adjustable with respect to the supporting structure in a direction parallel to the pivoting axis of the shaft mounted therein.

19. The linking device of claim 1, wherein the first bowed needle is mounted on a first arm, constrained to the first shaft and rigidly pivoting therewith; and the first pin is mounted on a first auxiliary arm, constrained to the first shaft, rigidly pivoting therewith, and angularly spaced from the first arm.

20. The linking device of claim 1, wherein the second bowed needle is mounted on a second arm, constrained to the second shaft and rigidly pivoting therewith; and the second pin is mounted on a second auxiliary arm, constrained to the second shaft, rigidly pivoting therewith, and angularly spaced from the second arm.

21. A machine for linking edges of a knitted article, the machine comprising:

engagement members, configured and arranged for engaging loops of the knitted article; and a linking device comprising a first bowed needle mounted on a first shaft and a second bowed needle mounted on a second shaft, wherein the first shaft and the second shaft are mutually inclined to each other and are controlled in order to pivot reciprocatingly around a pivoting axis of the first shaft and a pivoting axis of the second shaft, respectively, wherein the first shaft is rigidly coupled to a first pin pivoting therewith, the second shaft being rigidly coupled to a second pin pivoting therewith, wherein a slider is slidingly mounted on the first pin and on the second pin.

* * * * *